US012312948B2

(12) United States Patent
Rivas Martinez et al.

(10) Patent No.: US 12,312,948 B2
(45) Date of Patent: May 27, 2025

(54) DOWNHOLE FILTRATION SYSTEMS AND RELATED METHODS IN OIL AND GAS APPLICATIONS

(71) Applicant: Saudi Arabian Oil Company, Dhahran (SA)

(72) Inventors: Mario Augusto Rivas Martinez, Dhahran (SA); Daniel Thomas Scott, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/994,737

(22) Filed: Nov. 28, 2022

(65) Prior Publication Data

US 2024/0175350 A1 May 30, 2024

(51) Int. Cl.

| | |
|---|---|
| ***E21B 47/12*** | (2012.01) |
| ***E21B 21/00*** | (2006.01) |
| ***E21B 21/08*** | (2006.01) |

(52) U.S. Cl.
CPC ..... *E21B 47/12* (2013.01); *E21B 21/002* (2013.01); *E21B 21/08* (2013.01)

(58) Field of Classification Search
CPC ..... E21B 47/12; E21B 21/002; E21B 21/08
See application file for complete search history.

(56) References Cited

U.S. PATENT DOCUMENTS

| | | | | |
|---|---|---|---|---|
| 8,651,181 | B2 | 2/2014 | Knobloch et al. | |
| 10,378,339 | B2 | 8/2019 | Costa de Oliveira et al. | |
| 10,557,330 | B2 | 2/2020 | Costa de Oliveira et al. | |
| 10,597,962 | B2 | 3/2020 | Costa de Oliveira et al. | |
| 10,689,913 | B2 | 6/2020 | Costa de Oliveira et al. | |
| 10,689,914 | B2 | 6/2020 | Costa de Oliveira et al. | |
| 11,414,942 | B2 | 8/2022 | Yahya et al. | |
| 2006/0065444 | A1* | 3/2006 | Hall | E21B 21/002 175/314 |
| 2014/0116681 | A1* | 5/2014 | Broussard | E21B 27/005 166/227 |
| 2015/0000378 | A1* | 1/2015 | Kent | E21B 33/0355 73/38 |
| 2017/0314357 | A1* | 11/2017 | Kent | E21B 47/06 |
| 2023/0114032 | A1* | 4/2023 | Atkins | E21B 37/00 166/244.1 |
| 2024/0052717 | A1 | 2/2024 | Costa de Oliveira et al. | |
| 2024/0141744 | A1 | 5/2024 | Costa de Oliveira et al. | |

FOREIGN PATENT DOCUMENTS

| | | |
|---|---|---|
| CA | 2511628 | 1/2006 |

* cited by examiner

*Primary Examiner* — Dany E Akakpo
(74) *Attorney, Agent, or Firm* — Fish & Richardson P.C.

(57) ABSTRACT

A downhole filtration system for use in a drill string includes a filter assembly configured to filter debris from a drilling fluid, a first pressure sensor located at an uphole end of the filter assembly, a second pressure sensor located at a downhole end of the filter assembly, and a control unit configured to receive and transmit data from the first and second pressure sensors to surface equipment in real time.

19 Claims, 3 Drawing Sheets

DOWNHOLE FILTRATION SYSTEMS AND RELATED METHODS IN OIL AND GAS APPLICATIONS

TECHNICAL FIELD

This disclosure relates to downhole filtration systems for use in drill strings, such as a smart downhole filtration system that monitors plugging of a downhole filtration system in real time.

BACKGROUND

Filter subs are utilized during drilling operations to prevent debris from entering various downhole tools along a drill string. However, filter subs may become plugged with debris and accordingly become inefficient. There is no technology available that indicates whether a filter sub has become plugged with debris to alert personnel of the need for mud cleaning or improved solids control efficiency.

SUMMARY

This disclosure relates to a downhole filtration system for use in a drill string, such as a smart downhole filtration system that automatically monitors plugging of the system in real time to assess system performance.

In one aspect, a downhole filtration system for use in a drill string includes a filter assembly configured to filter debris from a drilling fluid, a first pressure sensor located at an uphole end of the filter assembly, a second pressure sensor located at a downhole end of the filter assembly, and a control unit configured to receive and transmit data from the first and second pressure sensors to surface equipment in real time.

Embodiments may provide one or more of the following features.

In some embodiments, the downhole filtration system is configured to allow through-flow of the drilling fluid.

In some embodiments, the downhole filtration system is configured to detect a difference in pressure between the uphole end and the downhole end.

In some embodiments, the difference in pressure indicates plugging of the filter assembly.

In some embodiments, the control unit includes one or more receivers.

In some embodiments, the one or more receivers are configured to receive the data from the first and second pressure sensors in real time.

In some embodiments, the one or more receivers are configured to receive remote commands from the surface equipment in real time.

In some embodiments, the remote commands include an activation signal.

In some embodiments, the remote commands include a deactivation signal.

In some embodiments, the control unit is configured to receive and transmit data wirelessly.

In some embodiments, the control unit includes one or more transmitters.

In some embodiments, the one or more transmitters are configured to transmit the data from the first and second pressure sensors to the surface equipment in real time.

In another aspect, a method of filtering a drilling fluid includes passing the drilling fluid through a filter assembly of a downhole filtration system, detecting an uphole pressure at a first pressure sensor located at an uphole end of the filter assembly, detecting a downhole pressure at a second pressure sensor located at a downhole end of the filter assembly, and transmitting data including the uphole and downhole pressures from a control unit of the downhole filtration system to surface equipment in real time.

Embodiments may provide one or more of the following features.

In some embodiments, the method further includes determining a difference between the uphole and downhole pressures.

In some embodiments, the method further includes preventing plugging of one or more components of a drill string positioned downhole of the downhole filtration system.

The details of one or more embodiments are set forth in the accompanying drawings and description. Other features, aspects, and advantages of the embodiments will become apparent from the description, drawings, and claims.

DETAILED DESCRIPTION

Figure 1:
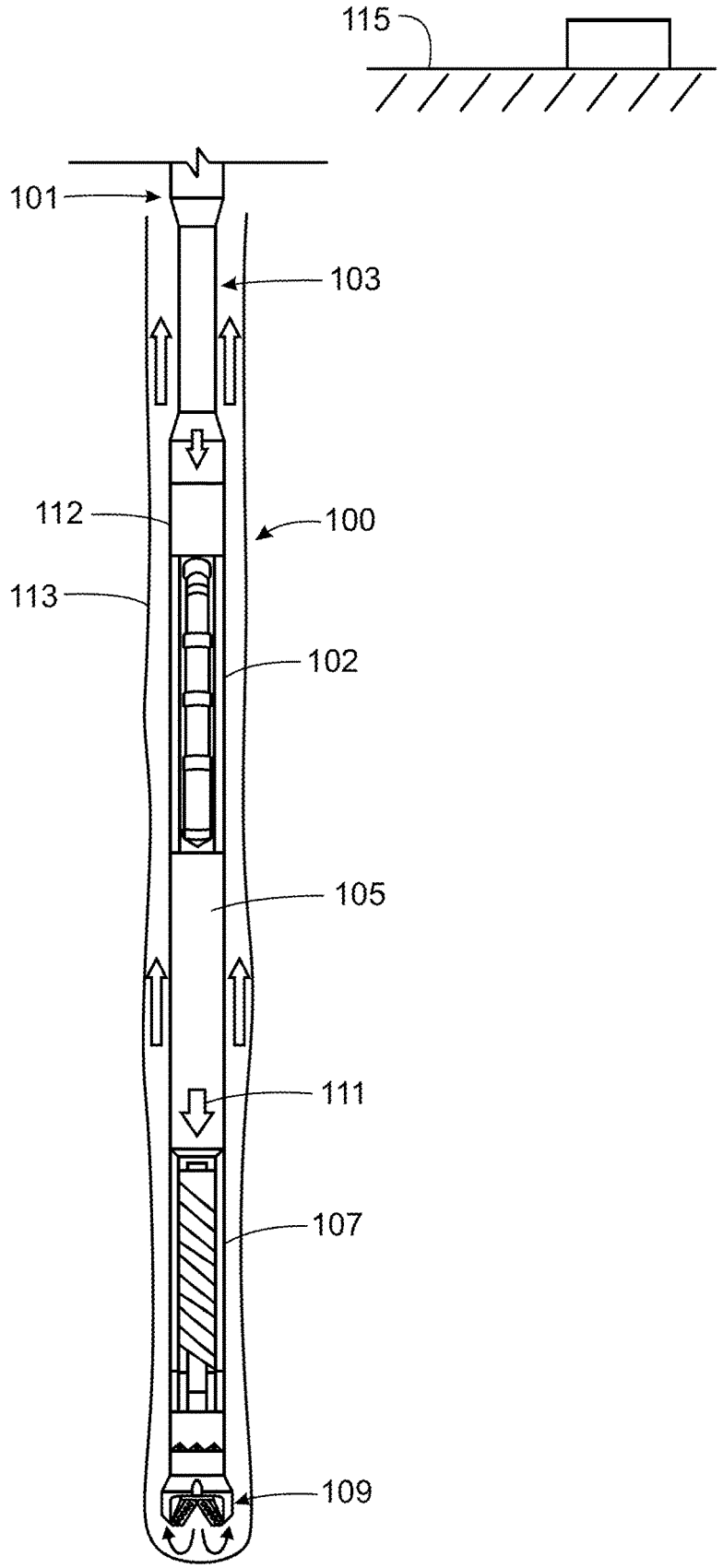
FIG. 1 is a side view of an example drill string including a downhole filtration system.

FIG. 1 illustrates an example downhole filtration system 100 that filters drilling fluid 111 (e.g., drilling mud or other fluid) within a drill string 101 during a drilling and workover operation to form a wellbore 113 (e.g., an oil or gas well). The drill string 101 includes a drill pipe 103 located above the downhole filtration system 100 and a measurement-while-drilling (MWD) system 105 located below the downhole filtration system 100. The drill string 101 also includes a mud motor 107 located below the MWD system 105 and a drill bit 109 that forms a downhole end of the drill string 101.

Figure 2:
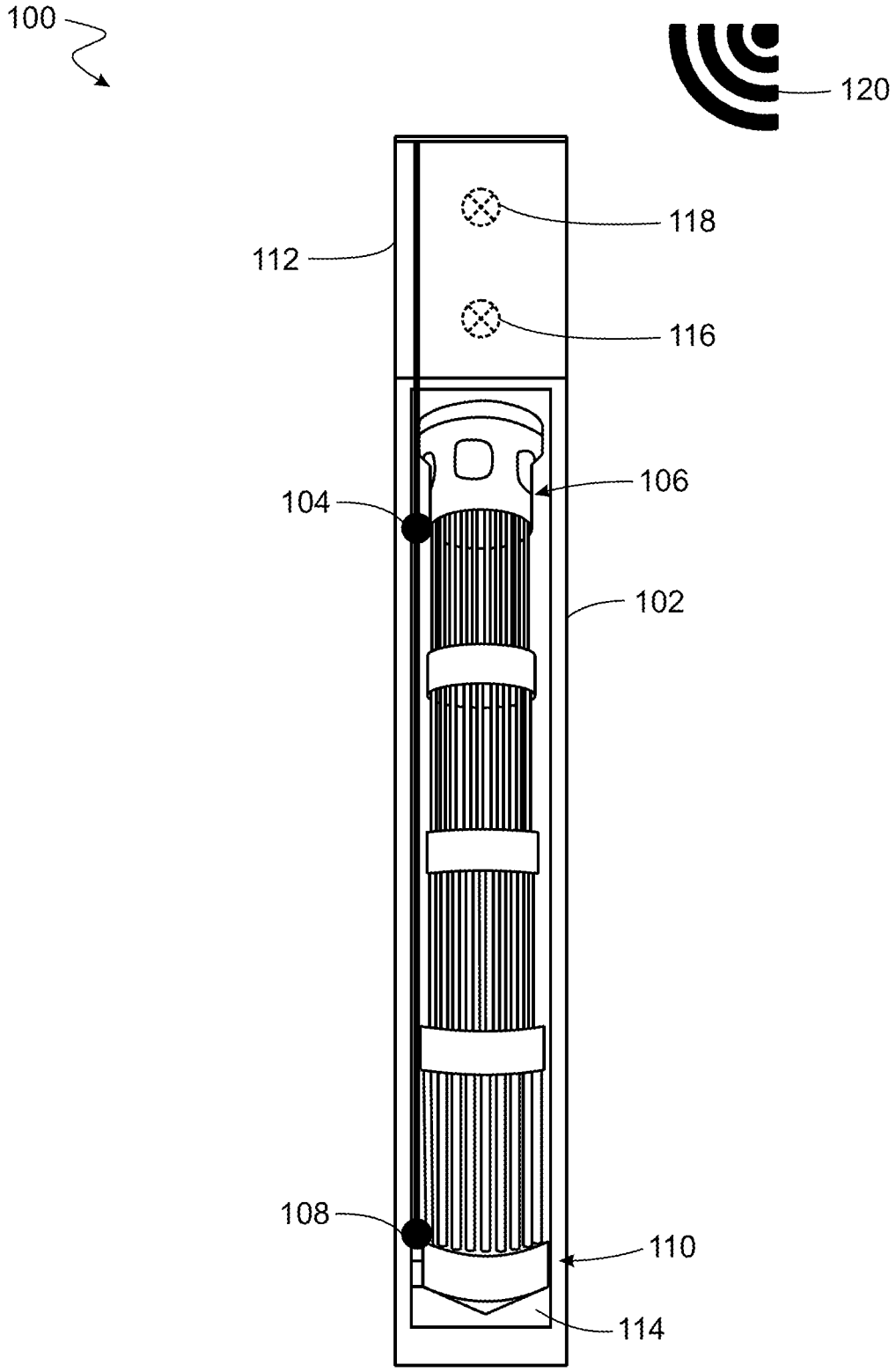
FIG. 2 is an enlarged side view of the downhole filtration system of FIG. 1.

The downhole filtration system 100 is a smart, automated system that acquires equipment diagnostic data and transmits the data to the surface 115 (e.g., equipment located at the surface 115) in real time. Referring to FIG. 2, the downhole filtration system 100 includes a filter assembly 102 (e.g., a filter sub), an uphole pressure sensor 104 positioned near an uphole end 106 of the filter assembly 102, a downhole pressure sensor 108 positioned near a downhole end 110 of the filter assembly 102, and a control unit 112 located above the filter assembly 102. The filter assembly 102 filters (e.g., removes) debris from the drilling fluid 111 to prevent plugging (e.g., clogging) of internal regions or external surface regions of the MWD system 105, the mud motor 107, the drill bit 109, and other components (e.g., directional drilling tools) of the drill string 101. Owing to this functionality of the filter assembly 102, the downhole filtration system 100 is a protective tool that prevents damage to the remaining portion of the drill string 101.

The pressure sensors 104, 108 are located within an interior region 114 of the filter assembly 102. The pressure sensors 104, 108 are operable to detect internal pressures respectively above and below the downhole filtration system 100 in real time. Detection of a substantial difference in pressure between the uphole and downhole ends 106, 110 of the filter assembly 102 indicate an extent to which the downhole filtration system 100 is plugged with debris. In some examples, a pressure difference of about 344,738 Pa (about 50 psi) or greater indicates that action should be taken to address debris plugging.

The control unit 112 provides an interface between the filter assembly 102 and the surface 115. The control unit 112 includes one or more receivers 116 that receive data (e.g., pressure measurements and other measurements) from the pressure sensors 104, 108. The one more receivers 116 also receive data (e.g., remote commands) from the surface 115. In some examples, commands received from the surface 115 cause or allow the downhole filtration system 100 to functionally activate or deactivate (e.g., for an unlimited number of times). The control unit 112 further includes one or more transmitters 118 that transmit data received from the pressure sensors 104, 108 to the surface 115 and that transmit data received from the surface 115 to the pressure sensors 104, 108 or other components of the filter assembly 102. In some embodiments, the one or more receivers 116 and the one or more transmitters 118 may be designed to receive and send commands and other data wirelessly (e.g., illustrated as a wireless signal 120), electromagnetically, or in a wired manner.

The control unit 112 and the pressure sensors 104, 108 together form a closed-loop communication system that delivers a full diagnostic analysis of the downhole filtration system 100 to the surface 115 in real-time. In this way, the control system 112 manages information between the surface 115 and the downhole filtration system 100. On the whole, the downhole filtration system 100 addresses the need to improve verification of debris accumulation inside of filter subs that are utilized during drilling and workover operations in oil and gas wells. For example, the automated features of the downhole filtration system 100 provides an improved efficiency of drilling and workover operations as compared to that provided by conventional filter subs.

The downhole filtration system 100 provides an early indication that debris has been encountered in the filter assembly 102 so that immediate action can be taken to improve cleaning of the drilling fluid 111 (e.g. to improve mud cleaning or solids control efficiency). Such action may prevent or delay the need to remove (e.g., pull out) the filtration system 100 from the wellbore 113 to clean the filter assembly 102. Similarly, such action may prevent damage to various components of the drill string 101 below the downhole filtration system 100 and thus eliminate the need to perform multiple, undesired trips to change out or clean the downhole filtration system 100. Accordingly, use of the downhole filtration system 100 minimizes non-productive time at wellbore 113 and accordingly provides a significant yearly cost savings.

Figure 3:
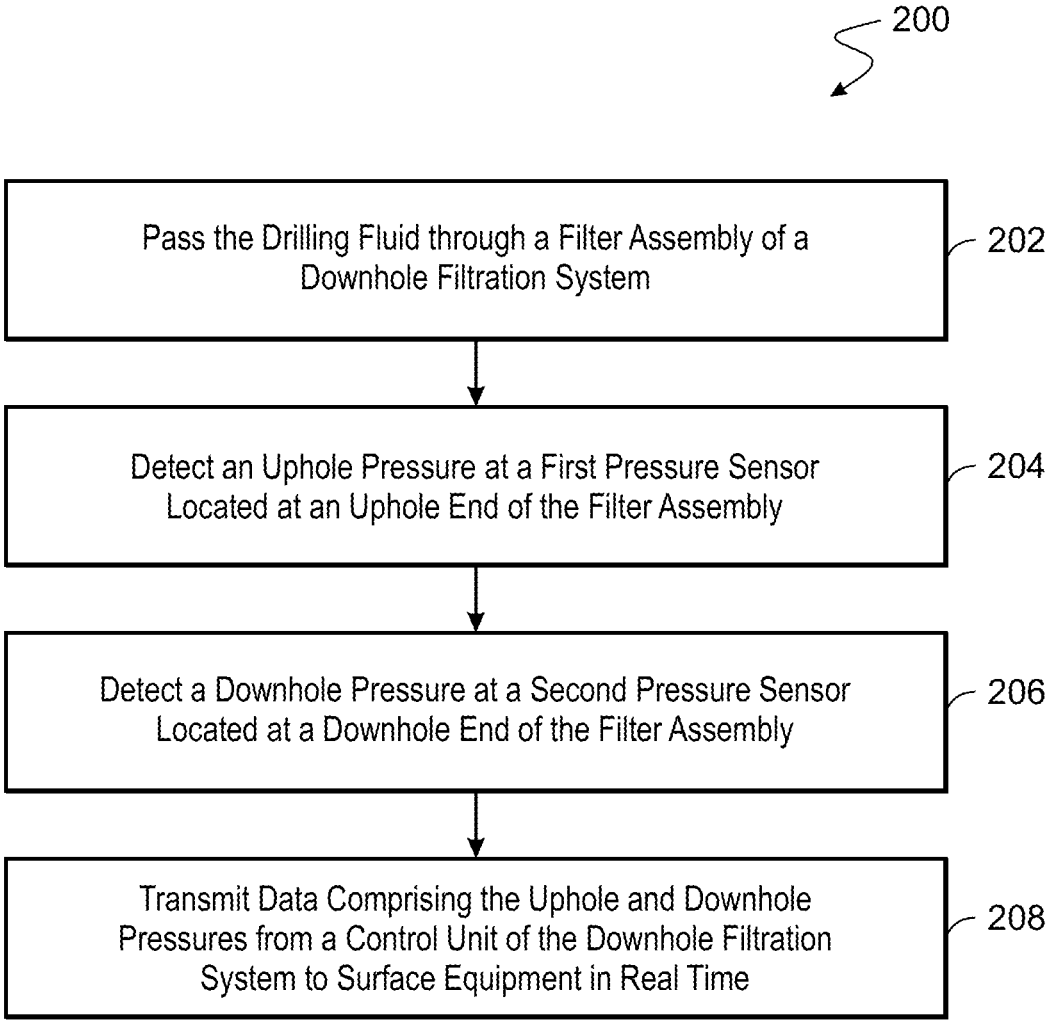
FIG. 3 is a flow chart illustrating an example method of filtering a drilling fluid utilizing the downhole filtration system of FIG. 1.

FIG. 3 is a flow chart illustrating an example method 200 of filtering a drilling fluid (e.g., the drilling fluid 111). In some embodiments, the method 200 includes a step 202 for passing the drilling fluid through a filter assembly (e.g., the filter assembly 102) of a downhole filtration system (e.g., the downhole filtration system 100). In some embodiments, the method 200 includes a step 204 for detecting an uphole pressure at a first pressure sensor (e.g., the uphole pressure sensor 104) located at an uphole end (e.g., the uphole end 106) of the filter assembly. In some embodiments, the method 200 includes a step 206 for detecting a downhole pressure at a second pressure sensor (e.g., the downhole pressure sensor 108) located at a downhole end (e.g., the downhole end 110) of the filter assembly. In some embodiments, the method 200 includes a step 208 for transmitting data including the uphole and downhole pressures from a control unit (e.g., the control unit 112) of the downhole filtration system to surface equipment in real time.

While the downhole filtration system 100 has been described and illustrated with respect to certain dimensions, sizes, shapes, arrangements, materials, and methods, in some embodiments, a downhole filtration system that is otherwise substantially similar in construction and function to the downhole filtration system 100 may include one or more different dimensions, sizes, shapes, arrangements, configurations, and materials or may be utilized according to different methods. Accordingly, other embodiments are also within the scope of the following claims.

What is claimed is:

1. A downhole filtration system for use in a drill string, the downhole filtration system comprising:

a filter assembly configured to filter debris from a drilling fluid;

a first pressure sensor located at an uphole end of the filter assembly and within an interior region of the filter assembly, the first pressure sensor positioned to measure a first drilling fluid pressure above the filter assembly;

a second pressure sensor located at a downhole end of the filter assembly, downstream of the first pressure sensor with respect to a flow of the drilling fluid, and within the interior region of the filter assembly, the second pressure sensor positioned to measure a second drilling fluid pressure in a region internal to a downhole portion of the drill string that is below and downstream of the filter assembly; and a control unit located at an uphole end of the filter assembly and configured to receive and transmit data comprising the first and second drilling fluid pressures from the first and second pressure sensors to surface equipment in real time, wherein the control unit and the first and second pressure sensors together form a closed-loop communication system, wherein the downhole portion of the drill string comprises a measurement-while-drilling (MWD) system such that the downhole filtration system is configured to use the measurements of the first and second drilling fluid pressures to prevent plugging of interior regions and external surface regions of the MWD system by improving cleaning of the drilling fluid with detection of the debris.

2. The downhole filtration system of claim 1, wherein the downhole filtration system is configured to allow through-flow of the drilling fluid.

3. The downhole filtration system of claim 1, wherein the downhole filtration system is configured to detect a difference in pressure between the uphole end and the downhole end.

4. The downhole filtration system of claim 3, wherein the difference in pressure indicates plugging of the filter assembly.

5. The downhole filtration system of claim 1, wherein the control unit comprises one or more receivers.

6. The downhole filtration system of claim 5, wherein the one or more receivers are configured to receive the data from the first and second pressure sensors in real time.

7. The downhole filtration system of claim 5, wherein the one or more receivers are configured to receive remote commands from the surface equipment in real time.

8. The downhole filtration system of claim 7, wherein the remote commands comprise an activation signal.

9. The downhole filtration system of claim 7, wherein the remote commands comprise a deactivation signal.

10. The downhole filtration system of claim 1, wherein the control unit is configured to receive and transmit data wirelessly.

11. The downhole filtration system of claim 1, wherein the control unit comprises one or more transmitters.

12. The downhole filtration system of claim 11, wherein the one or more transmitters are configured to transmit the data from the first and second pressure sensors to the surface equipment in real time.

13. The downhole filtration system of claim 1, wherein the first pressure sensor is configured to detect an internal uphole pressure above the downhole filtration system in real time, and wherein the second pressure sensor is configured to detect an internal downhole pressure below the downhole filtration system in real time.

14. The downhole filtration system of claim 13, wherein the control unit is configured to determine a difference between the internal uphole and internal downhole pressures, and wherein the difference, when about 50 psi or greater, comprises an indicator to address debris plugging of the filter assembly.

15. The downhole filtration system of claim 1, wherein the downhole filtration system is configured such that a difference in a pressure between the uphole end and the downhole end of the filter assembly of about 50 psi indicates that an action is needed to address debris plugging of the downhole filtration system, and wherein the control unit is configured to receive a deactivation signal to deactivate the downhole filtration system.

16. A method of filtering a drilling fluid, the method comprising:

passing the drilling fluid through a filter assembly of a downhole filtration system;

detecting an uphole pressure above the filter assembly at a first pressure sensor located at an uphole end of the filter assembly and within an interior region of the filter assembly;

detecting a downhole pressure in a region internal to a downhole portion of a drill string that is below and downstream of the filter assembly at a second pressure sensor, the second pressure sensor located at a downhole end of the filter assembly, downstream of the first pressure sensor with respect to a flow of the drilling fluid, and within the interior region of the filter assembly; and transmitting data comprising the uphole and downhole pressures from a control unit of the downhole filtration system to surface equipment in real time, wherein the control unit is located atop the filter assembly, wherein the control unit and the first and second pressure sensors together form a closed-loop communication system, and wherein the downhole portion of the drill string comprises a measurement-while-drilling (MWD) system such that the downhole filtration system is configured to use the measurements of the uphole and downhole pressures to prevent plugging of interior regions and external surface regions of the MWD system by improving cleaning of the drilling fluid with detection of the debris.

17. The method of claim 16, further comprising determining a difference between the uphole and downhole pressures.

18. The method of claim 16, further comprising preventing plugging of one or more components of the drill string positioned downhole of the downhole filtration system.

19. The method of claim 16, wherein the downhole filtration system is configured such that a difference in a pressure between the uphole end and the downhole end of the filter assembly of about 50 psi indicates that an action is needed to address debris plugging of the downhole filtration system, and wherein the control unit is configured to receive a deactivation signal to deactivate the downhole filtration system.

* * * * *